US011565397B2

(12) United States Patent
Roberts et al.

(10) Patent No.: US 11,565,397 B2
(45) Date of Patent: Jan. 31, 2023

(54) ROLLING WORK BENCH

(71) Applicants: Stanley P. Roberts, Loganville, GA (US); Jamie Edwards, Norcross, GA (US); Jake Roberts, Albany, GA (US)

(72) Inventors: Stanley P. Roberts, Loganville, GA (US); Jamie Edwards, Norcross, GA (US); Jake Roberts, Albany, GA (US)

( * ) Notice: Subject to any disclaimer, the term of this patent is extended or adjusted under 35 U.S.C. 154(b) by 290 days.

(21) Appl. No.: 16/866,964

(22) Filed: May 5, 2020

(65) Prior Publication Data

US 2021/0347034 A1 Nov. 11, 2021

(51) Int. Cl.

| | |
|---|---|
| ***B25H 1/04*** | (2006.01) |
| ***B25H 1/16*** | (2006.01) |
| *B25H 1/12* | (2006.01) |

(52) U.S. Cl.

CPC ..... *B25H 1/04* (2013.01); *B25H 1/16* (2013.01); *B25H 1/12* (2013.01)

(58) Field of Classification Search

CPC ..... B25H 1/04; B25H 1/12; B25H 1/16

See application file for complete search history.

(56) References Cited

U.S. PATENT DOCUMENTS

| | | | | |
|---|---|---|---|---|
| 5,642,895 | A * | 7/1997 | Wunder | B62B 1/12 280/30 |
| 5,701,843 | A * | 12/1997 | Lazides | A01K 1/0245 119/512 |
| 6,837,501 | B1 * | 1/2005 | Hedrick | B62B 1/002 280/30 |
| 7,210,697 | B2 * | 5/2007 | Simpson | B62B 5/06 16/446 |
| 10,807,229 | B1 * | 10/2020 | Chiao | B25H 3/028 |
| 2017/0190344 | A1 * | 7/2017 | Bengtzen | B62B 5/0079 |
| 2019/0270471 | A1 * | 9/2019 | Hazzard | B25H 1/16 |
| 2020/0171646 | A1 * | 6/2020 | Liu | H02G 11/02 |

FOREIGN PATENT DOCUMENTS

| | | | | |
|---|---|---|---|---|
| WO | WO-2016093710 A1 * | 6/2016 | | B25H 1/04 |

* cited by examiner

*Primary Examiner* — Matthew W Ing
(74) *Attorney, Agent, or Firm* — Ronald D. Baker; Baker & Co. Patent Law

(57) ABSTRACT

The present apparatus is an improved work bench for conveniently performing various tasks. In particular, the apparatus allows a user to uniquely complete difficult jobs in an easier manner. The proposed embodiment provides a unique experience for a user by providing a pleasant experience.

19 Claims, 4 Drawing Sheets

ROLLING WORK BENCH

CROSS-REFERENCE TO RELATED APPLICATIONS

None.

BACKGROUND OF THE APPARATUS

Field of the Art

The disclosure relates to an improved work bench, and more particularly the apparatus is an embodiment that provides a multifaceted method of performing tasks. The embodiment allows a user to manually configure the bench to complete a multitude of challenging jobs.

Discussion of the State of the Art

Work benches are popular tools for completing many challenging tasks. Many professionals from carpenters to mechanics have relied on the traditional work bench to assist with completing tasks. The traditional work benches are designed to often perform one or at most two jobs at once. To clarify, historically work benches were used as either upright structures that would store tools such as hammers to complete jobs. Generally, the work benches were stationary with no immediate access to things such as power sources which meant that a user had to make sure the work bench located near a power outlet. Using a work bench of this type proved to be difficult for heavy jobs that may require welding for instance. Additionally, the need for a safe platform to work from made it even challenging for users. Accordingly, what is needed in the art is a novel manner of performing tasks that require a versatile work bench. What is further needed in the art is a novel apparatus that will allow a user to perform such tasks in an easy manner without much effort to help eliminate the difficulty of using work benches. The proposed embodiment is further ideal because its ultimate purpose is to allow users to interchangeably use the work bench in a manner that will be a welcoming change for craftsmen.

SUMMARY OF THE APPARATUS

Accordingly, the inventor has conceived, in a preferred embodiment of the apparatus, an improved work bench.

According to a preferred embodiment of the apparatus, is an improved work bench that allows the user to transport the work bench to various locations in a novel manner. What is further disclosed is an improved work bench that provides a way for the user to easily transform the work bench into a workstation that will allow the user to utilize such things as magnification tools and mobile devices with the embodiment. What is further disclosed is an improved work bench that can be converted and used as a carrier for other tools or material. The transformation is a key component of the apparatus in that it greatly increases the ability of the user to utilize various aspects of the work bench while performing other tasks.

BRIEF DESCRIPTION OF THE DRAWING FIGURES

The accompanying drawings illustrate several embodiments of the apparatus and, together with the description, serve to explain the principles of the apparatus according to the embodiments. It will be appreciated by one skilled in the art that the particular embodiments illustrated in the drawings are merely exemplary and are not to be considered as limiting of the scope of the apparatus or the claims herein in any way.

DETAILED DESCRIPTION

Figure 1:
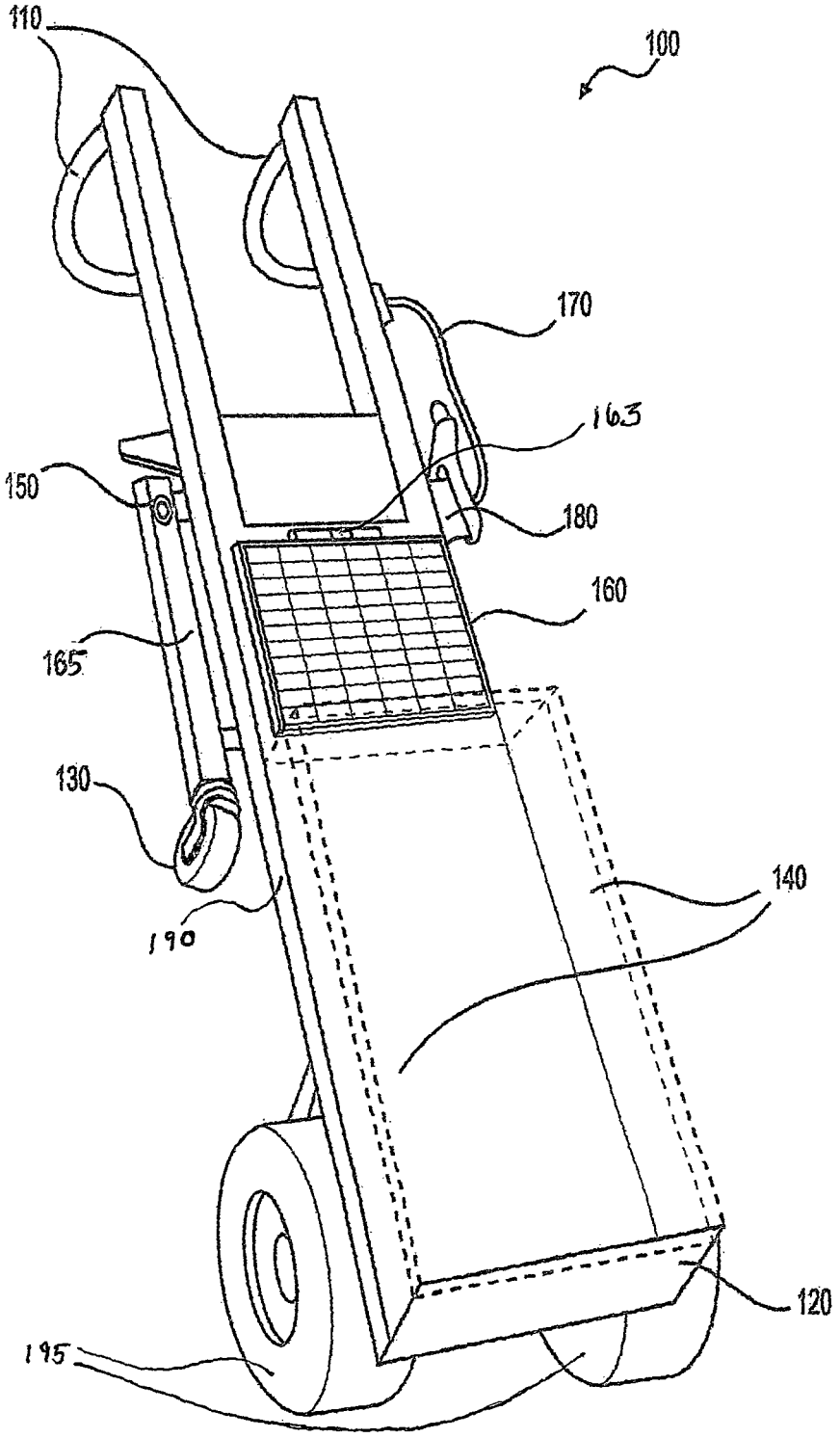
FIG. 1 is a perspective view of an improved work bench for conveniently performing various tasks, according to a preferred embodiment of the apparatus.

The inventor has conceived, a novel work bench for completing challenging tasks and transporting material and the like in a convenient manner.

The terms "a" or "an", as used herein, are defined as one, or more than one. The term "plurality", as used herein, is defined as two, or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an exemplary embodiment" or similar terms means that a particular feature, structure, or characteristic described in connection with the embodiment is included in at least one embodiment of the present apparatus. Thus, the appearances of such phrases or in various places throughout this specification are not necessarily all referring to the same embodiment. Furthermore, the particular features, structures, or characteristics may be combined in any suitable manner in one or more embodiments without limitation.

Thus, the appearances of such phrases or in various places throughout this specification are not necessarily all referring to the same embodiment.

Numerous alternative embodiments may be described; it should be appreciated that these are presented for illustrative purposes only and are not limiting of the disclosure contained herein or the claims presented herein in any way. One or more of the apparatus may be widely applicable to numerous embodiments, as may be readily apparent from the disclosure. In general, embodiments are described in sufficient detail to enable those skilled in the art to practice one or more of the apparatus, and it should be appreciated that other embodiments may be utilized and that structural changes may be made without departing from the scope of the particular apparatus. Accordingly, one skilled in the art will recognize that one or more of the apparatus may be practiced with various modifications and alterations. Particular features of one or more of the apparatus described herein may be described with reference to one or more particular embodiments or figures that form a part of the present disclosure, and in which are shown, by way of illustration, specific embodiments of one or more of the apparatus. It should be appreciated, however, that such features are not limited to usage in the one or more particular embodiments or figures with reference to which they are described. The present disclosure is neither a literal description of all embodiments of one or more of the apparatus nor a listing of features of one or more of the apparatus that must be present in all embodiments.

Headings of sections provided in this patent application and the title of this patent application are for convenience only and are not to be taken as limiting the disclosure in any way.

A description of an embodiment with several components in connection with each other does not imply that all such components are required. To the contrary, a variety of optional components may be described to illustrate a wide variety of possible embodiments of one or more of the apparatus and in order to more fully illustrate one or more aspects of the apparatus.

Materials described or referenced herein will sometimes be described in singular form for clarity. However, it should be appreciated that particular embodiments may include multiple instantiations of a material unless noted otherwise. Layers in some embodiments can be understood as representing segments or portions of those embodiments. Alternate implementations are included within the scope of embodiments of the present apparatus would be understood by those having ordinary skill in the art.

Definitions

Pivoting front wheels refer to a set of front wheels with a smaller diameter than the rear set of wheels that can pivot or retract beneath of the Rolling Work Bench once the Rolling Work Bench is positioned horizontally to be towed. Further where it is desirable for the user to push or pull the embodiment the front wheels can pivot downward to allow the embodiment to maneuver on four wheels.

Reference throughout this document to "detachable platform" or similar terms refers to a table that can be used along the rear portion of the work bench to allow users to perform tasks. Thus, the appearances of such phrases or in various places throughout this specification are not necessarily all referring to the same embodiment. Furthermore, the particular features, structures, or characteristics may be combined in any suitable manner in one or more embodiments without limitation.

Reference throughout this document to "detachable holders", "holders", "coupling mounts", "detachable mounts" or similar terms refers to various equipment that is used to hold various tools while using the embodiment. The detachable mounts are removable while not in use or interchanged where larger or smaller tools are needed for specific tasks. Thus, the appearances of such phrases or in various places throughout this specification are not necessarily all referring to the same embodiment.

Reference throughout this document to "U-bar", "towing mechanism", or similar terms refers to a moveable attachment to the embodiment that pivots to the vertical and horizontal position and allows a user to connect the rolling work bench to a tow bar for transport purposes. Thus, the appearances of such phrases or in various places throughout this specification are not necessarily all referring to the same embodiment.

Reference throughout this document to "tow bar", or similar terms refers to a mechanism that is used to attach to the U-bar to a motorized vehicle in the event the embodiment will need to be transported. In essence, the tow bar is considered an attachment that allows a user to connect the rolling work bench and towing mechanism to motorized equipment to transport the rolling work bench. Thus, the appearances of such phrases or in various places throughout this specification are not necessarily all referring to the same embodiment.

In an embodiment, the Rolling Work Bench is designed to provide a unique and novel manner for a user to utilize different configurations while performing various jobs. The Rolling Work Bench is designed with coupling mounts that will be applied by the user. Where the user has a particular job to complete and will need the assistance of a work bench but the job will require different work bench configurations then it should be appreciated that the Rolling Work Bench will be designed to either change configurations based on the job at hand or allow the user to include various mounts that will make the job easier. Mounts of various configurations can be attached in different locations of the embodiment that is useful for holding tools or other comparable devices so the user can easily perform tasks. This ability will provide the user with broader options while performing tasks that would be otherwise difficult. It can be appreciated the Rolling Work Bench is designed to provide space for tools such a moveable magnifying glass to be attach to assist the user.

In an alternate embodiment, if a user's yard or work area involves the user tackling tough terrains, steep hills, or high grass, the Rolling Work Bench can make a user's job much easier where traditional work benches would not provide such ease. To further illustrate, the embodiment can be positioned in a horizontal position that converts it into a rolling carrier coupled to the tow bar which will be attached to a tractor or a similar vehicle to easily transport material on the Rolling Work Bench. The embodiment can be lowered to a horizontal position and connected to an adjacent motorized towing device such as a tractor; by using connecting rods or similar devices to couple the towing mechanism to the adjacent towing device to ensure that the embodiment will be securely affixed while being pulled. Furthermore, once in the horizontal position, the user can place three panels adjacent to a fixed chamfered lower ledge along one edge of the body to form an enclosed box-shaped area for storage. In essence, the user will be able to move the embodiment over tough terrain such as rugged gravel and high grass while hauling material. It can be appreciated that the embodiment will be designed to include a top to enclose the carrier. Due to the four ruggedly designed wheels that are attached to the embodiment, obstacles such as hills, grass or similar terrain can be overcome. It will be appreciated that the embodiment can be manually pushed or pulled by utilizing the handles affixed to the vertical bars or the embodiment can be coupled to a motorized vehicle by utilizing tow bar. This option will allow a user to manually roll the embodiment by pivoting the front wheels downward in a vertical position to allow the embodiment to rest horizontally. Alternatively, if the user needs extra assistance from a vehicle such as a tractor, the embodiment can be towed. Additionally, it will be appreciated that the embodiment can utilized as a hand truck as well by placing the Rolling Work Bench in an upright position. This position will allow the user to maneuver heavy material by placing the material on the chamfered lower ledge of the embodiment and tilting the vertical bars toward the user allowing the embodiment to roll on the larger rear wheels. Once in the vertical upright position, the material will be able to lay against a vertical rectangular ledge that forms the body member.

In an embodiment, the Rolling Work Bench has the ability to convert to a work desk by mounting a detachable platform to the embodiment that serves to hold things such as laptops, cell phones, or other related items. The embodiment is configured to allow a platform to be attached to one vertical edge of the Rolling Work Bench in a perpendicular fashion. Users will appreciate electrical outlets that will be designed along the embodiment in various locations to allow electronic devices to be utilized for various tasks; the Rolling Work Bench will include a central power cord to be plugged into an external outlet as a primary power source. Additionally, where a light is needed to complete a job, the user can utilize the outlet that is located on the Rolling Work Bench to power the light once the power cord is plugged into a nearby power source.

In a non-limiting example, the Rolling Work Bench can also be designed with solar panels to provide energy when the embodiment is being utilized in a location where a power outlet is not available. As an example, if the user is utilizing the Rolling Work Bench in field where there is no access to a power outlet, the Rolling Work Bench can utilize solar energy due to the solar panels which can be designed in an ideal location on the Rolling Work Bench. The solar panel rotates by utilizing a first rotatable hinge.

This feature will allow the user to perform necessary work where electrical power is not available but is critical for the job.

In a non-limiting example, the detachable platform may be designed in various widths and lengths to satisfy a user's preference. For instance, where a user utilizes a laptop that is much larger than a small mobile device and is needed to assist with a task then the embodiment can be designed to accommodate the larger laptop. This will allow the user to utilize various devices while performing jobs on the Rolling Work Bench.

In an exemplary embodiment, the Rolling Work Bench includes handles located near the top of the embodiment along the vertical bars to allow a user to hold and transport the embodiment. In a non-limiting example, the embodiment can be used in an upward position as a hand truck or lowered by the user while utilizing the handles to change the configuration for the previously mentioned towing mechanism attachment for transporting material.

Exemplary Embodiments

FIG. 1 is a perspective view of an improved work bench 100 for conveniently performing various tasks, according to a preferred embodiment of the apparatus. According to the embodiment an improved work bench 100 comprises at least two handles 110, a bottom ledge 120, retractable front wheels 130. The embodiment also comprises a solar panel 160 as an optional energy source, body 190, and detachable side surfaces 140. The solar panel 160 is designed to rotate upward or downward by a first rotatable hinge 163 for positioning the solar panel for optimal sunlight. The retractable front wheels 130 further comprises a second set of hinges 150 coupled along the top edge of an attached bar 165. The second set of hinges 150 are designed to allow the attached bar 165 to rotate in a vertical position to allow the embodiment to be supported by the retractable front wheels 130. In a non-limiting example, the attached bar 165 can be manufactured in a way to allow the bar to be extended to change the height of one edge of the Rolling Work Bench that will be suitable for the user. Accordingly, the embodiment also includes rear wheels 195, a power cord 170 and detachable mounts 180.

Figure 2:
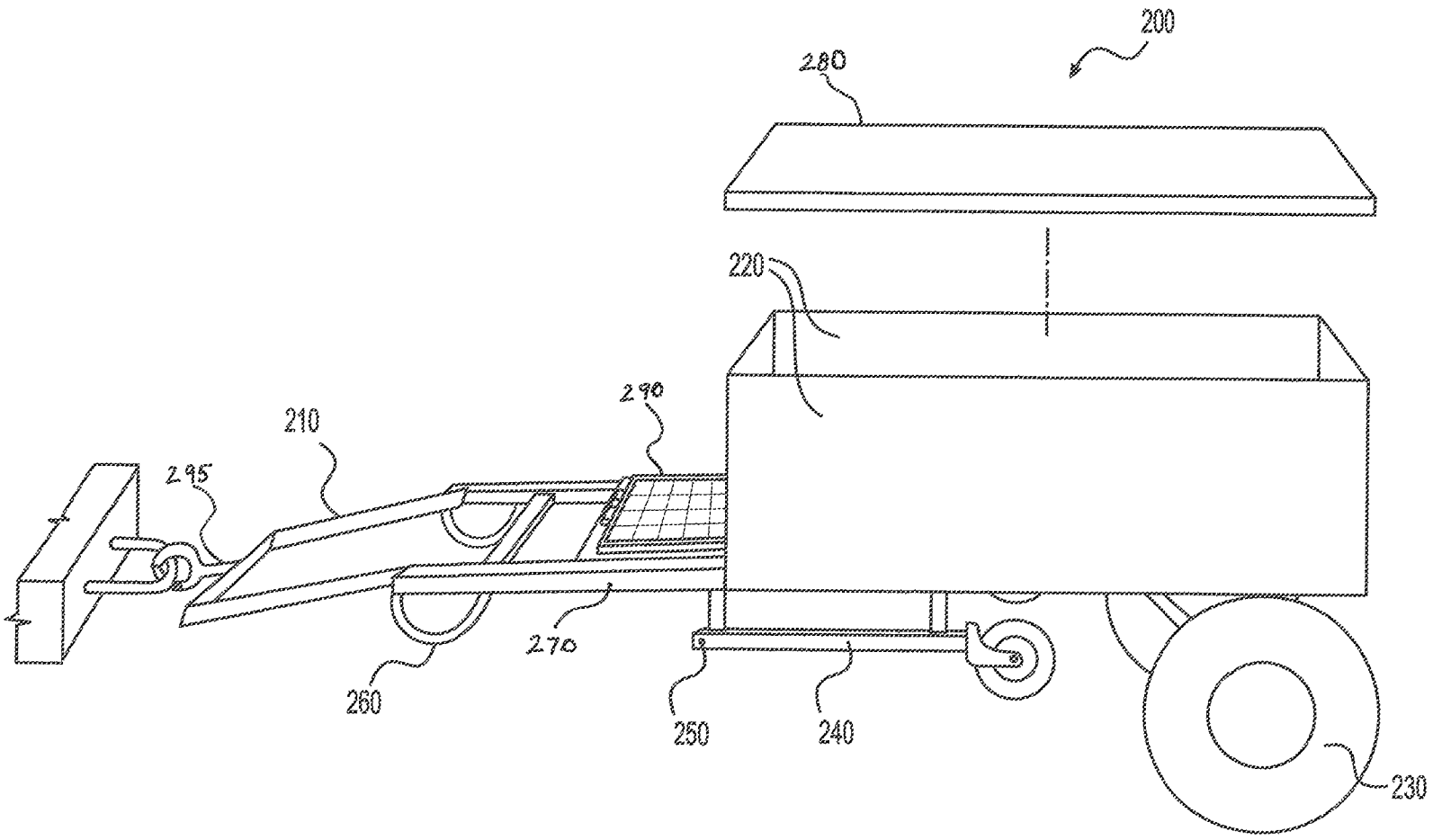
FIG. 2 is a side view of an improved work bench for conveniently performing various tasks, according to a preferred embodiment of the apparatus.

FIG. 2 is a side view of an improved work bench 200 for conveniently performing various tasks, according to a preferred embodiment of the apparatus. According to the embodiment, the improved work bench 200 is attached to a towing mechanism 210 by a connecting rod 295 which is typically used to haul the improved work bench based on a user's preference. The embodiment of the improved work bench illustrates a top cover 280, body 270, and detachable side panels 220 when installed that holds material during transport. Accordingly, the embodiment also includes a view of the solar panel 290, handles, 260, the rear wheels 230, and retractable front bar and wheels 240 along with the second set of rotatable hinges 250.

Figure 3:
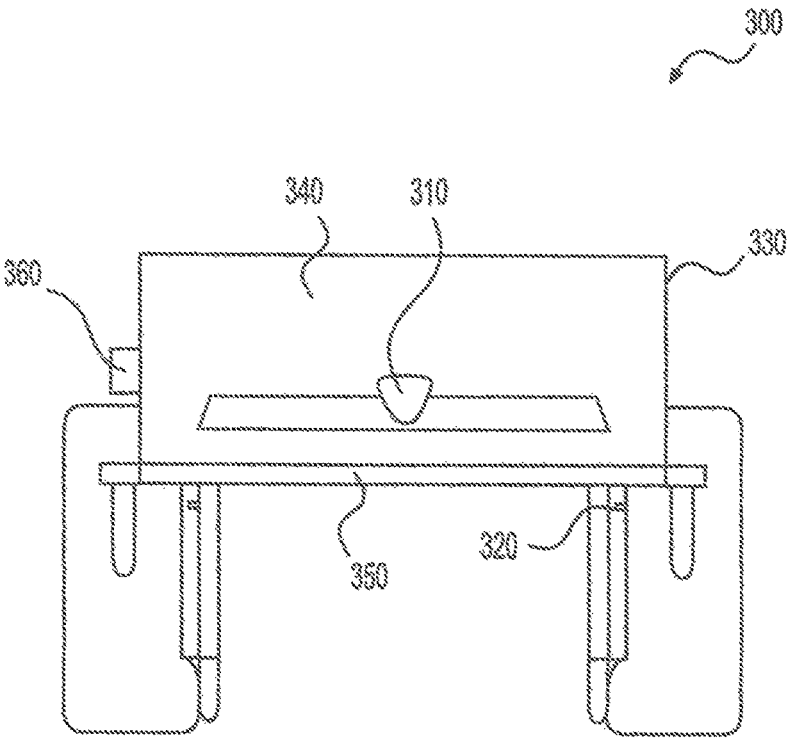
FIG. 3 is a front view of an improved work bench for conveniently performing various tasks, according to a preferred embodiment of the apparatus.

FIG. 3 is a front view of an improved work bench for conveniently performing various tasks, according to a preferred embodiment of the apparatus. Accordingly, the view includes the improved work bench 300 comprises a tow mechanism 310, a second set of hinges 320, detachable side panels 330, front panel 340, and body 350. Advantageously, the embodiment 300 includes mounts 360 for securing various tools to the improved work bench.

Figure 4:
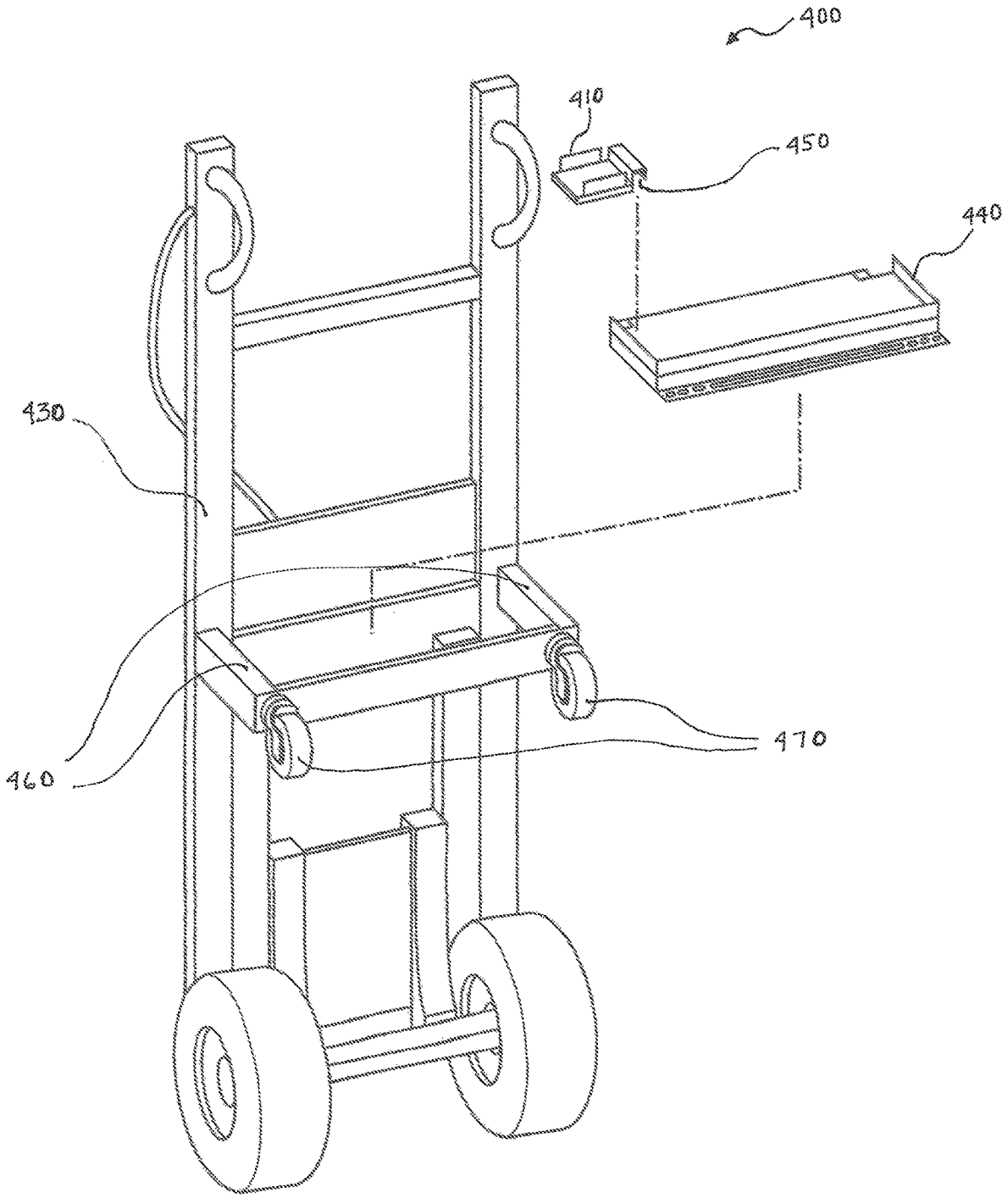
FIG. 4 is a perspective view of a detachable platform and coupling mount and how they affix, according to a preferred embodiment of the apparatus.

FIG. 4 is a perspective view 400 of a detachable platform 440 and a coupling mount 410 and how they affix to the body 420 of the work bench 430. Accordingly, the view illustrates how both the detachable platform 440 and mount 410 attach to the platform 440 by utilizing a notched groove 450. The detachable platform 440 abuts to the side of the work bench 430 once it is fully attached. In an ideal position, the detachable platform 440 rests along the top of the horizontally positioned bars 460 that extends from the front wheels 470.

The skilled person will be aware of a range of possible modifications of the various embodiments described above. Accordingly, the present apparatus is defined by the claims and their equivalents.

What is claimed is:

1. An improved work bench comprising:

a body, a pair of vertical bars, a solar panel, at least two handles, at least two retractable front bars, at least three side panels, a top, front wheels, rear wheels, detachable platform, power cord, at least two detachable mounts, towing mechanism, and towing bar wherein said retractable front bars further includes extendable arms for moving the arms from a fully retracted position when the retractable front bars are in a stored position to a fully extended position when the retractable front bars are in a vertical support position.

2. The improved work bench of claim 1 wherein said at least two handles are positioned along a top edge of said pair of vertical bars.

3. The improved work bench of claim 1 wherein said pair of vertical bars extend from the body.

4. The improved work bench of claim 1 wherein said pair of vertical bars further includes said solar panel operable by a first rotatable hinge for positioning the solar panel when in use for optimal sunlight.

5. The improved work bench of claim 1 wherein said at least three side panels and said top are detachable; whereby said top can be placed horizontally along one side of said at least three side panels that are attachable in a perpendicular fashion along the body and adjacent to the bottom ledge to form an enclosed box.

6. The improved work bench of claim 1 wherein said front wheels are attached to said at least two retractable front bars.

7. The improved work bench of claim 1 wherein said front wheels further pivot vertically when in use.

8. The improved work bench of claim 1 wherein said rear wheels are attached to a rear lower portion of the body.

9. The improved work bench of claim 1 wherein said detachable platform is attached to a rear upper portion of the body to form a work desk.

10. The improved work bench of claim 1 wherein said power cord is attached to the side of the upper portion of said pair of vertical bars.

11. The improved work bench of claim 1 wherein said towing mechanism is attached to an upper portion of the vertical bars.

12. The improved work bench of claim 1 wherein said towing mechanism is connected to the vertical bars by at least one connecting rod.

13. The improved work bench of claim 1 wherein said tow bar is connected to a center bar of the towing mechanism.

14. The improved work bench of claim 1 wherein the body includes said pair of vertical bars and at least one cross member extending between said pair of vertical bars.

15. An improved work bench comprising: a body, a pair of vertical bars, a solar panel, at least two handles, at least two retractable front bars, at least three side panels, a top, front wheels, rear wheels, detachable platform, power cord, at least two detachable mounts, towing mechanism, and towing bar; wherein said front wheels are attached to said at least two retractable front bars; wherein said at least two retractable front bars are attached to the body at an end opposite of the front wheels.

16. An improved work bench comprising: a body, a pair of vertical bars, a solar panel, at least two handles, at least two retractable front bars, at least three side panels, a top, front wheels, rear wheels, detachable platform, power cord, at least two detachable mounts, towing mechanism, and towing bar; wherein said front wheels further includes a second set of hinges that allow the retractable front bars to rotately move in a stored position wherein said wheels are adjacent to and parallel with the body of the work bench.

17. An improved work bench comprising: a body, a pair of vertical bars, a solar panel, at least two handles, at least two retractable front bars, at least three side panels, a top, front wheels, rear wheels, detachable platform, power cord, at least two detachable mounts, towing mechanism, and towing bar; wherein said detachable platform further include a detachable mount to attach to the detachable platform.

18. An improved work bench comprising: a body, a pair of vertical bars, a solar panel, at least two handles, at least two retractable front bars, at least three side panels, a top, front wheels, rear wheels, detachable platform, power cord, at least two detachable mounts, towing mechanism, and towing bar; wherein said detachable mounts are coupled along various locations of the detachable platform by utilizing notched grooves.

19. An improved work bench comprising: a body, a pair of vertical bars, a solar panel, at least two handles, at least two retractable front bars, at least three side panels, a top, front wheels, rear wheels, detachable platform, power cord, at least two detachable mounts, towing mechanism, and towing bar; wherein said retractable front bars further can be slidably extended downward or upward to adjust the height of the work bench during use.

* * * * *